US007735420B2

(12) United States Patent
Salvestro

(10) Patent No.: US 7,735,420 B2
(45) Date of Patent: Jun. 15, 2010

(54) IMAGING SYSTEM WITH MEDIA CARRIER STORAGE POSITION

(75) Inventor: Aldo Salvestro, Burnaby (CA)

(73) Assignee: Kodak Graphic Communications Canada Company, Burnaby, British Columbia (CA)

( * ) Notice: Subject to any disclaimer, the term of this patent is extended or adjusted under 35 U.S.C. 154(b) by 0 days.

(21) Appl. No.: 12/137,011

(22) Filed: Jun. 11, 2008

(65) Prior Publication Data

US 2008/0236429 A1 Oct. 2, 2008

Related U.S. Application Data

(62) Division of application No. 10/667,421, filed on Sep. 23, 2003, now Pat. No. 7,424,853.

(51) Int. Cl.
*B41C 3/08* (2006.01)

(52) U.S. Cl. ..... 101/401.1; 101/480; 101/486

(58) Field of Classification Search ..... 101/216, 101/401.1, 454, 465, 467, 479, 480, 485, 101/486; 347/110, 262, 263, 264
See application file for complete search history.

(56) References Cited

U.S. PATENT DOCUMENTS

| | | | | |
|---|---|---|---|---|
| 4,603,336 | A * | 7/1986 | Dufour et al. | 346/74.2 |
| 5,456,175 | A | 10/1995 | Haijima et al. | |
| 6,186,068 | B1 | 2/2001 | Gelbart | |
| 6,249,300 | B1 | 6/2001 | Kerr et al. | |
| 6,520,083 | B2 | 2/2003 | Petersen et al. | |
| 6,684,783 | B2 | 2/2004 | Salvestro | |
| 6,945,169 | B2 | 9/2005 | Gottling et al. | |
| 2003/0033949 | A1 * | 2/2003 | Salvestro | 101/401.1 |

* cited by examiner

*Primary Examiner*—Ren Yan
(74) *Attorney, Agent, or Firm*—Nelson Adrian Blish

(57) ABSTRACT

An apparatus for imaging a media is able to accommodate, in an imaging position, a drum for loading flat sheets of media or a mandrel for loading sleeve media. The apparatus includes a storage position for locating the drum or mandrel when not in use and provides mechanisms for safe transport of the drum or mandrel between the storage and imaging positions.

18 Claims, 4 Drawing Sheets

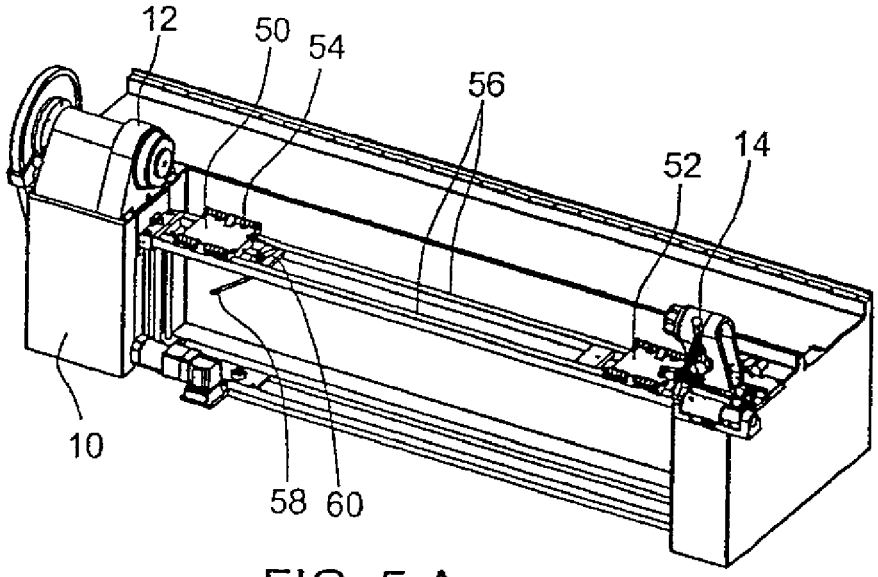
FIG. 5-A
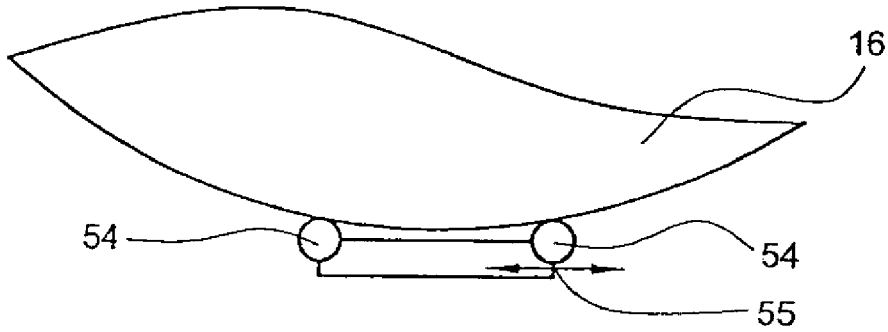
FIG. 5-B
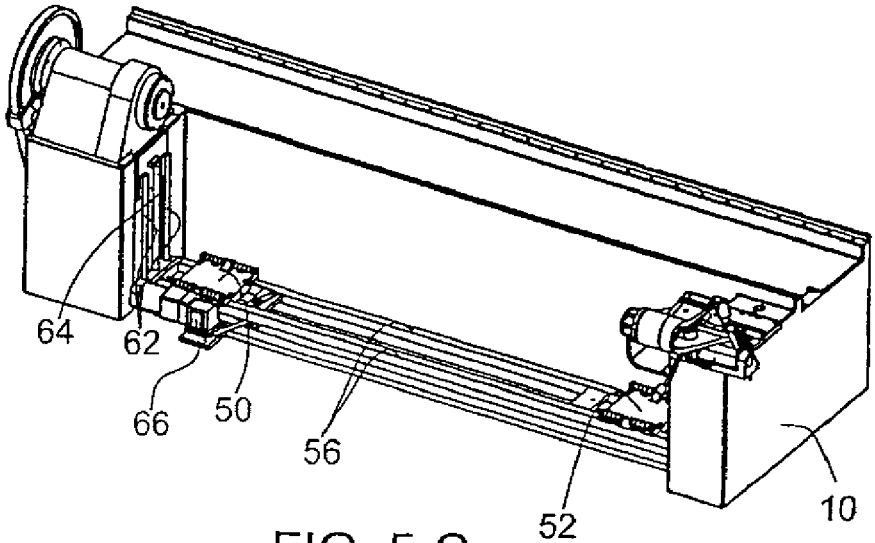
FIG. 5-C

IMAGING SYSTEM WITH MEDIA CARRIER STORAGE POSITION

CROSS REFERENCE TO RELATED APPLICATIONS

This is a divisional of application Ser. No. 10/667,421, filed Sep. 23, 2003, now U.S. Pat. No. 7,424,853.

FIELD OF THE INVENTION

The invention relates to the field of imaging printing precursor elements for use in printing operations.

BACKGROUND OF THE INVENTION

Digital imaging systems have now gained wide acceptance in the preparation of printing precursor elements for use in printing operations. For example, flexographic printing presses are widely used in the printing of packaging products where the use of a compressible relief imaging element is advantageous for printing on a variety of substrates including, for example, plastic and cardboard. A flexographic media generally comprises a layer of photopolymer that is exposed to UV radiation through an image mask, such as a film, to selectively harden the photopolymer.

In recent years digital flexographic media has become available with an integral image mask layer that is imaged in a digital imaging system using an imagewise-controllable laser source. The media is typically made available in flat plate sections that are adhered to a cylindrical flexographic printing form after the relief image has been formed and processed. Interest is growing in providing continuous flexographic elements that have no discernable seam joints around the periphery of the cylinder. Seamless flexographic printing elements are particularly useful in printing continuous repeat patterns such as wallpaper and wrapping paper.

The handling of both flat and seamless flexographic media presents a problem. Imaging devices, which use flat media have a cylindrical drum around which the flat media is wrapped. Imaging devices which use seamless media have a mandrel over which a sleeve can be loaded. Additionally flexographic printing forms are often used in very large format (VLF) sizes such as the ThermoFlex® 5280 sold by Creo Inc. of Burnaby, British Columbia, Canada, which is able to load flat media sized up to 52 inch by 80 inches. The large size of VLF media along with the industry demand to handle seamless sleeve formats presents a challenge for media handling.

The problem is not confined to the flexographic printing field. The handling of multiple formats of imaging media in lithographic platemaking, gravure, proofing, and other imaging areas also has the same problem that different media require different apparatus for imaging. There remains a need for better methods and apparatus for accommodating a variety of different sizes and formats of media in imaging devices.

SUMMARY OF THE INVENTION

A first aspect of the present invention provides an imaging apparatus with at least one media carrier and an imaging position for locating the media carrier such that an imaging media supported thereon is proximate to an imaging head. The apparatus has a storage position for storing at least one unused media carrier and a transport mechanism for moving the unused media carrier between the storage position and the imaging position.

Another aspect of the invention provides a method of imaging a media. An image is formed on a first media mounted on a first media carrier located in an imaging position and then the media carrier is transported to a storage position located proximate to the imaging position. A second media carrier is loaded in the imaging position an image is formed on a second media mounted on the second media carrier.

BRIEF DESCRIPTION OF THE DRAWINGS

In drawings which illustrate by way of example only preferred embodiments of the invention:

FIG. 1 is a perspective view of an imaging engine having a cylindrical drum in an imaging position;

FIG. 2 is a perspective view of an imaging engine having the cylindrical drum in a storage position;

FIG. 3 is a perspective view of the imaging engine having a sleeve and sleeve mandrel in the imaging position with the cylindrical drum in the storage position;

FIG. 4 is a perspective view of the imaging engine showing a method of loading or unloading the sleeve without removing the sleeve mandrel;

FIGS. 5-A, 5-B, and 5-C are perspective views of an imaging engine of an embodiment of the invention with the drum removed to show the drum transport mechanisms.

DETAILED DESCRIPTION OF THE INVENTION

Figure 1:
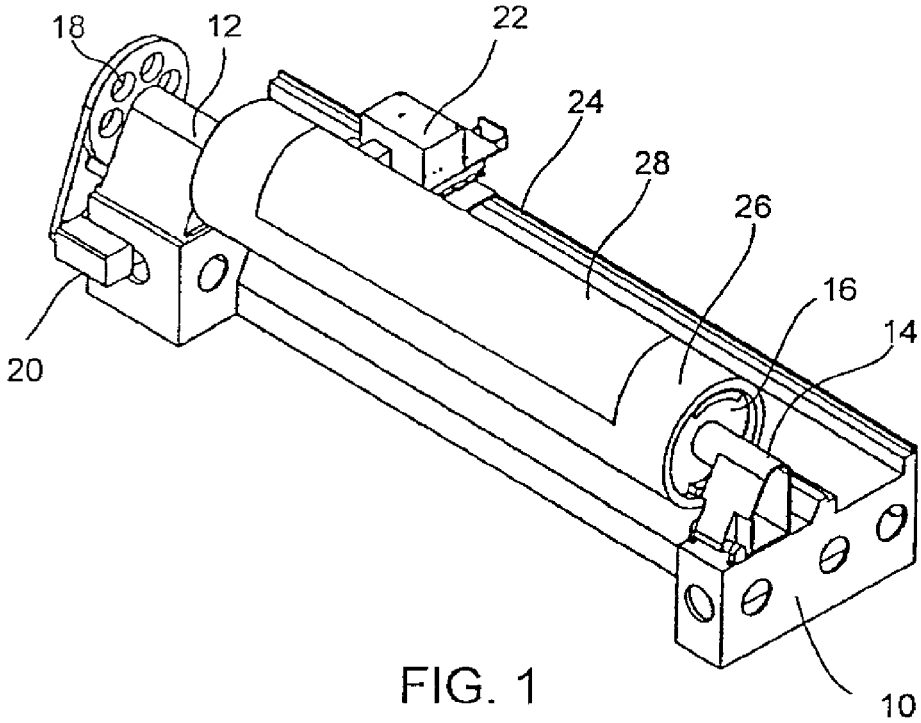
FIGS. 1-4 shown an embodiment of the apparatus.

Throughout the following description, specific details are set forth in order to provide a more thorough understanding of the invention. However, the invention may be practiced without these particulars. In other instances well known elements have not been shown or described in detail to avoid unnecessarily obscuring the invention. Accordingly, the specification and the drawings are to be regarded in an illustrative rather than a restrictive sense.

The invention is described in relation to an imaging system that accommodates one or more media carriers for mounting imaging media. The media carrier may be a sleeve mandrel for mounting a cylindrical sleeve media or a drum for mounting flat sheets of media and/or various combinations thereof. The system provides storage facilities, which may be integrated into the body of the device, for a drum or sleeve mandrel that is not being imaged, thus reducing or eliminating the need to provide separate safe storage for the media carrier when not in use.

Additionally the system may also allow media to be loaded onto a drum or mandrel when the drum or mandrel is in a storage position while another sheet or sleeve is being imaged on a different drum or mandrel. Drums and mandrels are examples of media carriers.

In an embodiment of the invention shown in FIG. 1 to FIG. 4, an imaging engine 8 has a frame 10 supporting a fixed headstock 12 and a moveable tailstock 14. A rotatable cylindrical drum 16 is shown supported between headstock 12 and tailstock 14. Headstock 12 is driven via a belt and pulley 18 by a motor 20. An imaging head 22 located on a linear track 24 is disposed to form an image on media 28 held on drum 16. The media 28 is scanned by a combination of the rotation of drum 16 and linear translation of exposure head 22 along track 24. Drum 16 is generally provided with some means for clamping a flat sheet of media 28. The clamping force may be provided by a vacuum applied via a series of holes and/or grooves in the surface 26 of drum 16 or may be provided by magnetic, spring clamps or any other suitable mechanical clamping means.

In general, it is necessary for drum 16 to be kept in precision alignment with tracks 24 as dictated by the design and configuration of the exposure head 22. In order to meet these precision requirements the attachment and alignment of drum 16 to headstock 12 and tailstock 14 employs components that may be susceptible to damage or contamination. Furthermore, should the surface 26 of drum 16 be damaged or debris be accumulated thereon, the imaging performance may be compromised by bumps or dents in the drum surface 26 that may transmit to the loaded media 28.

Figure 2:
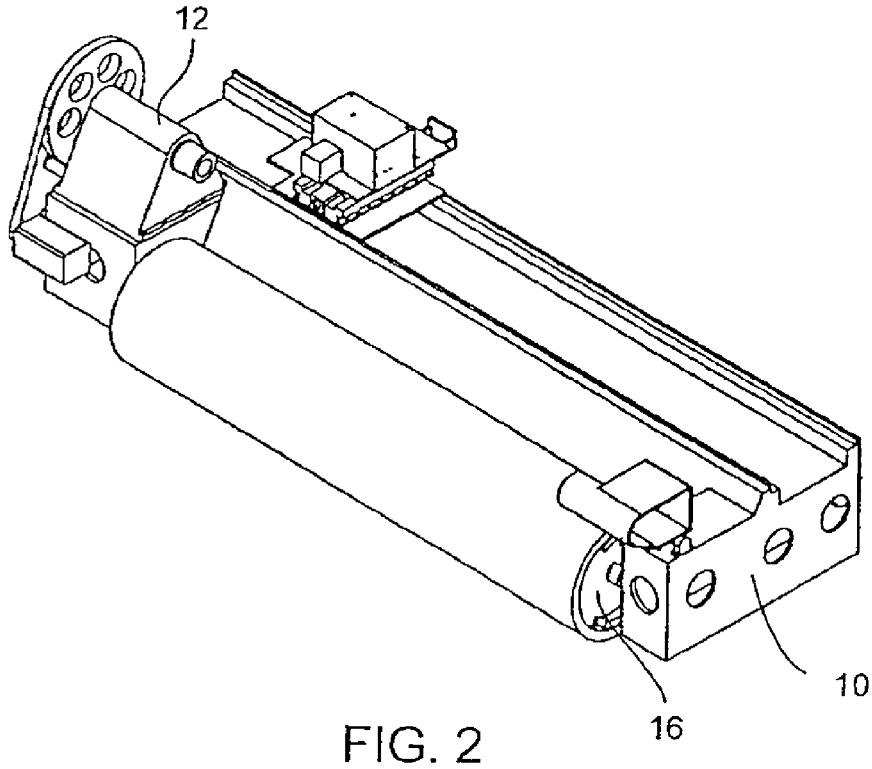
Figure 3:
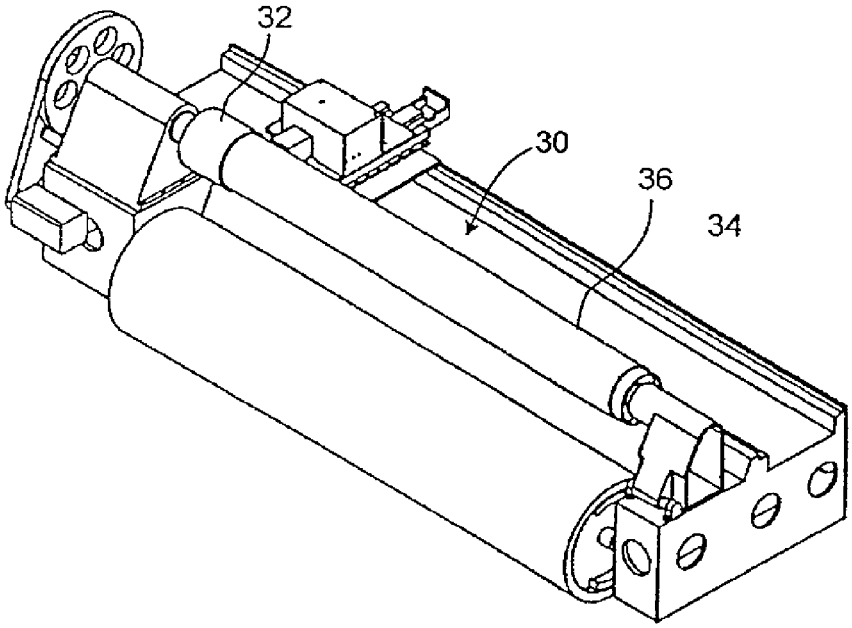

Once imaging is completed, drum 16 may be disengaged and moved into a storage position within the confines of the frame 10, or elsewhere within the enclosure of the imaging device. In FIG. 2 the drum 16 is shown in a storage position. The imaged media 28 may be removed from drum 16 either while drum 16 is in the imaging position or while the drum is in the storage position. Referring now to FIG. 3, once drum 16 is in its storage position, a sleeve on a mandrel 30 or on another drum (not shown) may be loaded into the imaging position.

Figure 4:
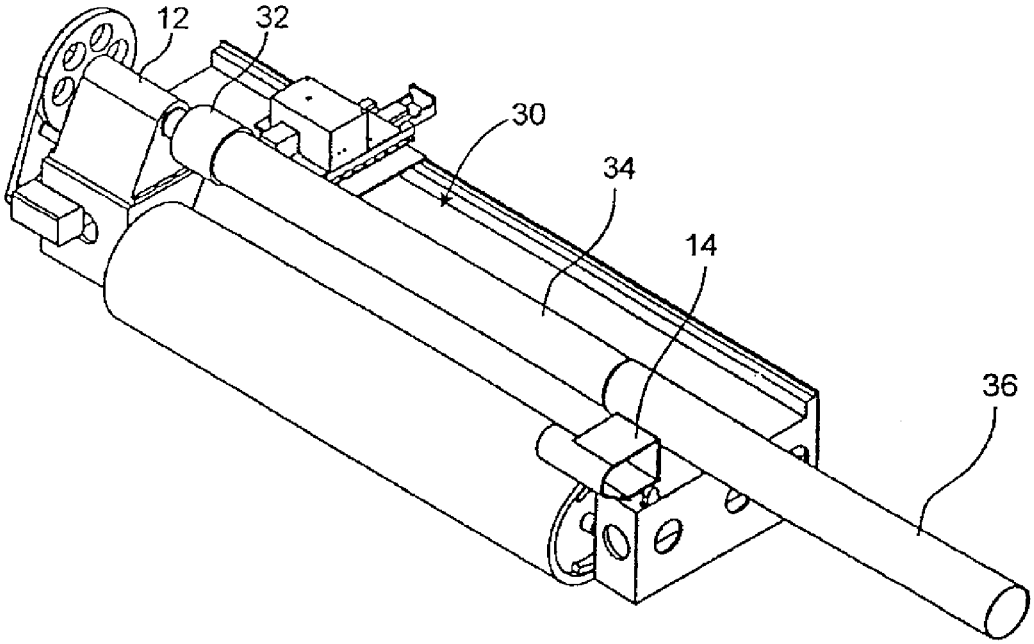

Mandrel 30 may be a two-part assembly comprising a universal arbor 32 with a shell 34 fitted over the arbour. Several shells of different diameters may be provided to accommodate a variety of different sleeves 36. Alternatively, as shown in FIG. 4, arbor 32 may be loaded first (with or without shell 34) and then sleeve 36 loaded over the shell 34. The sleeve 36 may be a thin-walled metal or composite cylindrical tube with the media applied to the outer surface. The outside diameter of shell 34 may be chosen to be slightly larger than the inside diameter of sleeve 36. Shell 34 may be provided with a number of air holes in its surface through which air can be forced. This permits sleeve 36 to be floated on a cushion of air onto the shell 34, the air expanding sleeve 36 to enable easy location. When the supply of forced air is discontinued, sleeve 36 contracts to form an interference fit with shell 34. In the embodiment shown in FIG. 4, arbor 32 is held in a cantilevered fashion by headstock 12, with tailstock 14 rotated out of the way as shown. This allows sleeve 36 to be loaded onto shell 34.

While in FIG. 3 and FIG. 4 mandrel 30 is shown as a two part structure comprising an arbor 32 and a shell 34, is should be appreciated that a mandrel may also be a single structure without a replaceable shell 34, albeit at potentially increased cost.

In an alternative embodiment, the media may be loaded onto the drum or a mandrel by manual or automated means while the drum or mandrel is in its storage position. By re-locating or duplicating the loading functions from the imaging position to the storage position, loading is decoupled from the imaging operation. This allows imaging and loading to proceed in parallel, thus increasing the throughput of the machine. The media carrier may also be a cylindrical printing element precursor where the image is formed on the coated or uncoated surface of the cylinder and the entire cylinder is moved to a printing press for use in a subsequent printing operation.

Apparatus according to the invention includes a transport mechanism capable of moving a drum from an imaging position to a storage position or vice versa. The transport mechanism is subject to a number of design considerations. Firstly, the time taken to enact a change between drum and mandrel should be commensurate with the overall productivity of the machine. Accordingly the engagement and disengagement of the headstock, tailstock and transport hardware should be arranged to meet repeatability and precision requirements without the need for unduly time consuming adjustments. At the same time, it is desirable to avoid the need for any manual motion of the drum. Requiring an operator to manually move a drum or mandrel is potentially dangerous since there is the potential for operator injury and/or damage to sensitive components.

FIGS. 5-A to 5-C show one possible embodiment for a transport mechanism. An engine frame 10 is shown with a headstock 12 and tailstock 14. In this particular embodiment, the drum is held in a pair of cradles 50 and 52. The drum is not shown to enable a clear view of the transport components but the drawing should be understood to have a drum located in the cradles 50 and 52 in normal use. Each cradle is equipped with a plurality of compliant rollers 54 that engage the drum surface without risk of damage. In FIG. 5-B, a lower portion of drum 16 is shown in cross section, resting on rollers 54. Rollers 54 may be, for example, a plurality of compliant rubber rollers or a single elongated rubber roller. Advantageously, if rollers 54 are rotatable, drum 16 may be rotated in the cradle for purposes of alignment during the unclamping at the headstock. The spacing between opposing rollers 54 may also be made adjustable in a direction shown by arrow 55 to allow accommodation of a larger variation in media carrier diameters. While in this embodiment the holder that engages the drum is shown as a cradle that contacts the underside of the drum or mandrel, this is not mandated. Any means of supporting the drum including, but not limited to any axial support means, is considered within the scope of the invention.

Returning now to FIG. 5-A cradles 50 and 52 are located on support rails 56, which support the cradles and allow movement in the direction laterally away from or towards the headstock. The movement disengages the drum from headstock 12 once the tailstock 14 has been disengaged and is activated by a lever 58 which is pivotally attached to cradle 50 and fixed support 60. A lateral movement of lever 58 is translated to the drum via cradle 50. Cradle 52 may be rigidly linked to cradle 50 so that the lateral movement of cradle 50 is translated to cradle 52 or alternatively, the weight of the drum 10 may be used to transfer the motion to cradle 52 with a spring bias to return cradle 52 to a home position when the drum is disengaged.

Referring now to FIG. 5-C, cradles 50 and 52 have been moved vertically downward to the storage position in frame 10. Again, the drum is not shown to enable a clear view of the transport mechanism. The vertical motion is provided by a second set of tracks 62 and a leadscrew 64 located at both the headstock side and tailstock side of tracks 56 (the second set of tracks for vertical motion is not visible in the view as shown). Leadscrew 64 is rotated by a drive mechanism 66 that may comprise, for example, an electric motor or a manual hand crank. Typically, since the drum is typically very heavy, drive mechanism 66 will drive both the headstock and the tailstock leadscrews 64 simultaneously via a belt or other means.

It should be understood that while the embodiment shown transports the drum along a substantially vertical path from the imaging to the storage position, the path may also be horizontal, slanted or even curved depending on the configuration of the frame. Additionally, while the transport mechanism is shown using tracks and a leadscrew there are many ways of accomplishing the same result. Other examples of transport mechanisms capable of moving a media carrier between imaging and storage positions are known to those skilled in the art and include various existing mechanisms such as mechanisms actuated by linear motors, hydraulic or pneumatic actuators, and so on.

Figure 6:
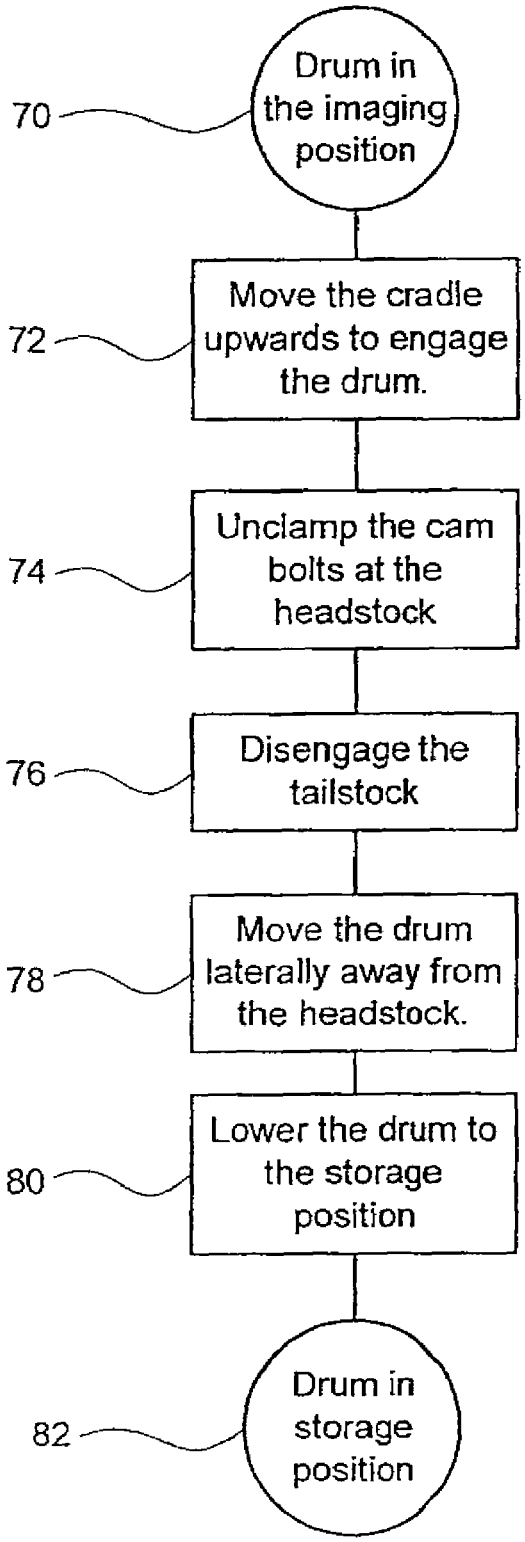
FIG. 6 is a flowchart depicting one embodiment of a method of the invention.

A method of operation of the transport mechanism is shown in the flowchart of FIG. 6. Starting with the drum in an imaging position in step 70, the cradles are brought up to engage the underside of the drum in step 72 thus supporting the drum prior to disengagement. In step 74, the drum axis is unclamped at the headstock. The unclamping may comprise releasing a set of cam bolts or other clamping means known in the art. In step 76, the tailstock is unclamped and axially disengaged from the drum. The tailstock may then be rotated out of the way.

The drum is then moved axially away from the headstock along a path defined by the transport hardware in step 78, thus freeing the drum from the headstock. In step 80, the drum may then be lowered in the cradle to the storage position. In step 82, the drum is secured in the storage position.

The example in FIG. 6, while specifically pertaining to the lowering of a drum to a storage position, may be reversed in order of steps to take a drum from a storage position to an imaging position. Likewise, the handling of sleeve mandrels is similarly accomplished. Furthermore, while in the embodiment described manual exchange of the drum assisted by transport hardware is contemplated but it should be easily appreciated by a person skilled in the art that some or all of the operations may be automatically performed without departing from the scope of the invention. It should be further understood that the embodiment of the method described may include additional steps to ensure safe handling of the drum or mandrel.

In an extension of the concept outlined in the aforegoing description, the storage may be extended to incorporate storage for a plurality of drums and/or sleeve mandrels simultaneously. Many such designs of a multi-storage device are possible with the potential to move a drum or mandrel into a load position from a storage position, load the media or sleeve thereon, and then move the drum or mandrel into an imaging position on completion of the previous image.

A wide range of media imaging systems may benefit from the methods and apparatus described herein including, but not limited to flexographic, lithographic, gravure, film and proofing media in either flat or sleeve format. Similarly the present invention may be beneficially applied in any case where combinations of different imaging media having different format, size or mounting requirements are to be imaged in a single imaging device. In many cases, the major difference between imagers for specific different media types is to be found in the media carrier where size, support and securing features are customized for the specific media. The imaging head may employ any of a variety of imaging processes known in the art and may be a controllable radiation source that effects some change in the media or removes material from the media. Alternatively, the imaging head may deposit material in response to image data, as would be the case if a mask material or other substance were to be inkjetted onto the media surface.

The invention has been described in detail with particular reference to certain preferred embodiments thereof, but it will be understood that variations and modifications can be effected within the scope of the invention.

The invention claimed is:

1. A method of imaging a media comprising:

providing an imaging device having a frame configured to provide a path between an imaging position and a storage position in said frame;

forming a first image on a first media mounted on a first media carrier located in the imaging position;

transporting the first media carrier to a storage position located proximate to the imaging position;

locating a second media carrier in the imaging position; and forming a second image on a second media mounted on the second media carrier.

2. The method of claim 1 comprising loading the first media onto the first media carrier while the first media carrier is located in the storage position.

3. The method of claim 1 comprising loading the second media onto the second media carrier while the second media carrier is located in the storage position.

4. The method of claim 1 comprising loading the first media onto the first media carrier while the first media carrier is located in the imaging position.

5. The method of claim 1 comprising loading the second media onto the second media carrier while the second media carrier is located in the imaging position.

6. The method of claim 1 comprising forming the second image on the second media mounted on the second media carrier while the first media carrier is located in the storage position.

7. The method of claim 1 comprising forming the second image on the second media while the second media carrier is located in the imaging position and the first media carrier is located in the storage position.

8. The method of claim 1 comprising forming the first image on the first media mounted on the first media carrier located in the imaging position while the second media carrier is located in a location other than in the storage position.

9. The method of claim 1 comprising providing a frame configured for providing a path between the imaging position and the storage position.

10. The method of claim 9 comprising providing a transport mechanism for moving a media carrier along the path between the imaging position and the storage position.

11. The method of claim 9 comprising providing a headstock and a tailstock adapted for engaging a media carrier in the imaging position and rotating the media carrier between the head stock and the tailstock.

12. The method of claim 11 comprising engaging the first media carrier with each of the headstock and the tailstock while forming the first image on the first media carrier located in the imaging location.

13. The method of claim 12 comprising disengaging the first media carrier from each of the headstock and the tailstock before moving the first media carrier along the path between the imaging position and the storage position.

14. The method of claim 11 comprising rotating the first media carrier between the headstock and the tailstock while forming the first image on the first media carrier located in the imaging location.

15. The method of claim 11 comprising rotating the first media carrier between the headstock and the tailstock while mounting the first media on the first media carrier.

16. The method of claim 11 comprising engaging the first media carrier with each of the headstock and the tailstock while mounting the first media on the first media carrier.

17. The method of claim 11 wherein one of the headstock and the tailstock are disengaged from the media carrier while mounting the media on the media carrier.

18. The method of claim 11 wherein at least one of the headstock and the tailstock are disengaged from the media carrier while mounting the media on the media carrier.

* * * * *